United States Patent [19]

Popp

[11] Patent Number: 4,596,688

[45] Date of Patent: Jun. 24, 1986

[54] CONTAINER FOR THE LONG-TERM STORAGE OF RADIOACTIVE MATERIALS

[76] Inventor: Franz-Wolfgang Popp, Kuhstrasse 5, 3002 Wedemark, Fed. Rep. of Germany

[21] Appl. No.: 449,567

[22] Filed: Dec. 14, 1982

[30] Foreign Application Priority Data

Dec. 17, 1981 [DE] Fed. Rep. of Germany ..... 3149945

[51] Int. Cl.[4] ..... G21C 19/40

[52] U.S. Cl. ..... 376/272; 220/67; 220/454; 228/184; 250/506.1

[58] Field of Search ..... 376/272; 250/506.1, 250/507.1; 219/59.1; 220/67, 3, 453–457; 228/184, 208, 226, 263.14, 263.15

[56] References Cited

U.S. PATENT DOCUMENTS

| | | | |
|---|---|---|---|
| 3,016,463 | 1/1962 | Needham | 250/506.1 |
| 3,046,403 | 7/1962 | Montgomery | 376/272 X |
| 3,163,501 | 12/1964 | Zimmer et al. | 228/263.15 X |
| 4,106,179 | 8/1978 | Bleckmann | 219/438 X |
| 4,245,698 | 1/1981 | Berkowitz et al. | 166/244 C |
| 4,278,892 | 7/1981 | Baatz et al. | 250/506.1 |
| 4,320,847 | 3/1982 | Gesser et al. | 220/352 X |
| 4,354,133 | 10/1982 | Vig | 310/344 |
| 4,366,095 | 12/1982 | Takats et al. | 250/506.1 X |

FOREIGN PATENT DOCUMENTS

| | | | |
|---|---|---|---|
| 0743714 | 12/1979 | Belgium . | |
| 0036954 | 10/1981 | European Pat. Off. | 250/506.1 |
| 1947398 | 4/1971 | Fed. Rep. of Germany . | |
| 1752606 | 7/1971 | Fed. Rep. of Germany . | |
| 2756700 | 6/1978 | Fed. Rep. of Germany | 250/506.1 |
| 2823172 | 12/1978 | Fed. Rep. of Germany | 250/506.1 |
| 2804828 | 8/1979 | Fed. Rep. of Germany . | |
| 2942092 | 4/1981 | Fed. Rep. of Germany | 250/506.1 |
| 1278475 | 10/1961 | France | 250/506.1 |
| 2009657 | 6/1979 | United Kingdom . | |

OTHER PUBLICATIONS

"*Welding and Metal Fabrication*", Cooper Alloys, McKeown, pp. 457–460, Sep. 1978.

*Primary Examiner*—Charles T. Jordan
*Assistant Examiner*—Daniel Wasil

[57] ABSTRACT

The invention is directed to a container for the long-term storage of radioactive materials such as irradiated nuclear reactor fuel elements. The container is made of a material such as steel, cast steel or the like. The container includes a vessel having an opening at one end for receiving the radioactive material stored therein and a cover which is welded to the vessel for closing the same. In this container, the base material provides the mechanical strength and stability. To make the entire container resistant to corrosion, the vessel and cover are provided with respective weld platings at the partition interface of the container. The weld platings are made of cold-weldable, corrosion resistant material and are applied by the surface layer welding process. Corrosion protective layers are formed on the outer surfaces of the cover and vessel, respectively, and cover the outer surfaces up to the region of the weld platings. The corrosion protective layers are preferably made of graphite, ceramic or enamel. After the weld platings and corrosion protective layers are applied, the cover and vessel can be placed in a hot cell wherein the vessel is filled with radioactive material. Thereafter, the cover is joined to the vessel with a weld made of cold-weldable material applied to the weld platings at the partition interface. A follow-up heat treatment is unnecessary and operations in the hot cell are kept simple and to a minimum.

22 Claims, 3 Drawing Figures

CONTAINER FOR THE LONG-TERM STORAGE OF RADIOACTIVE MATERIALS

FIELD OF THE INVENTION

The invention relates to a container for the long-term storage of radioactive materials such as spent nuclear reactor fuel elements and the like. The container can be made of a material such as steel or cast steel for example. The container includes a vessel having an opening at one of its ends for receiving the radioactive material to be stored therein and a cover which is welded to the vessel for sealing the same.

BACKGROUND OF THE INVENTION

Containers for storing radioactive materials are filled in a hot cell. Operations in a hot cell such as filling the vessel with radioactive material and joining the cover to the vessel are all carried out with apparatus that is remotely-controlled from a location outside of the cell. It is desirable to keep these operations within the hot cell simple and to a minimum because of the great expense and the technical effort involved with operations that must be conducted with remotely-controlled apparatus.

Containers for the long-term storage of radioactive materials must be mechanically stable, corrosion resistant and tightly sealed. If the vessel and cover are made of steel, the mechanical strength of the container is assured and the cover can be welded to the vessel in the hot cell by a simple welding process such as with the gas-shielded arc-welding process. However, the corrosion resistance of steel is inadequate for the purpose of long-time storage.

Also, it should be added that, in the case of the steel container, a follow-up heat treatment could be required to remove micro fissures occuring as a consequence of the welding operation. This is undesirable because the radioactive material in the container too would be heated and this could lead to radioactive gas leaking from the container.

It has already been suggested to make the container out of graphite for long-term storage since graphite has an excellent resistance to corrosion. The cover made of graphite is joined to the graphite vessel under conditions of high temperature and high pressure. However, this process of joining the cover to the vessel has to be conducted in the hot cell and such an operation involving high pressure and temperature in the hot cell is expensive and difficult. Furthermore, the mechanical strength of the graphite container is less than that of the steel container.

If the cover and vessel of a container were made of steel and each is coated with a protective layer such as graphite, ceramic or enamel, then the container would have the required mechanical strength and yet be corrosion resistant except for the weld seam laid down in the hot cell. To make the weld seam secure against corrosion could involve, for example, applying a coating of corrosive resistant material of the kind mentioned above to the weld seam. This could require the application of heat to the container which has been filled with radioactive material. The heat applied to the container would be transferred to the radioactive material which could cause radioactive gas to be generated and, if micro-fissures are present in the weld seam, the gas could seep from the closed container causing a dangerous condition to operating personnel who may later have to enter the hot cell. Thus, here too, follow-up work in the hot cell is required to make the seam resistant to corrosion and so make the container suitable for the long-term storage of radioactive material.

It would therefore be advantageous, if the container were made with steel as the base material in order to obtain the desired mechanical strength and stability and, if on the outside, the container were to carry a corrosive resistant protection layer of graphite, ceramic or enamel while at the same time being adapted to permit the cover to be joined to the vessel in a hot cell by a simple welding process without the need of a follow-up heat treatment operation or other activity involving a major engineering effort in the hot cell.

SUMMARY OF THE INVENTION

In view of the foregoing, it is an object of the invention to provide a container for the long-term storage of radioactive material which has high mechanical strength and is resistant to corrosion.

It is a further object of the invention to provide such a container which can be filled in a hot cell and then sealed with a simple welding operation to join the cover to the vessel without the need to conduct technically difficult and/or potentially dangerous follow-up operations in the hot cell.

A container of the invention for the long-term storage of radioactive materials such as spent nuclear reactor fuel elements or the like includes a vessel having a base and a wall extending upwardly from the base. The wall terminates in an upper end portion defining the opening of the vessel through which the radioactive material to be stored therein is passed. A cover for sealing the opening of the vessel is provided and has a peripheral portion for engaging the vessel. The upper end portion of the vessel and the peripheral portion of the cover define respective joint surfaces. The joint surfaces are mutually adjacent and define the partition interface between the vessel and cover when the cover is seated on the vessel.

According to a feature of the invention, weld receiving means are disposed at the partition interface for receiving a weld, the weld receiving means being made of cold-weldable, corrosive-resistant material. Corrosion-protective layer means are formed on the respective outer surfaces of the cover and the vessel. The layer means extends over each of the outer surfaces up to and is in contact with the weld receiving means whereby the corrosion-protective layer means and the weld receiving means conjointly cover and protect the respective entire outer surfaces of the vessel and the cover against corrosion. A weld made of cold-weldable, corrosion-resistant material is applied to the weld receiving means at said partition interface to tightly join the cover to the vessel thereby sealing the partition interface and the container with respect to the ambient.

The cover and the vessel both are made from a material selected from the group including steel and cast steel and the corrosion-protective layer means includes one layer formed on the outer surface of the vessel and an other layer formed on the outer surface of the cover. The layers are made of a material selected from the group including graphite, ceramic and enamel.

The weld receiving means includes: a first weld plating on the outer surface of the vessel which extends from the one layer on the vessel up to the joint surface thereof; and a second weld plating on the outer surface of the cover which extends from the other layer up to the joint surface of the cover.

The vessel and the cover of the container are separately provided with the weld plating before being placed in the hot cell. The weld platings are built up on the vessel and cover, respectively, by the process of surface-layer welding. This process is described, for example, in the text "Handbuch der Schweißtechnik" by J. Ruge, Volume I, Second Edition, page 170, published by Springer-Verlag (1980).

After being provided with the weld platings and before placement in the hot cell, the vessel and cover are each coated with the corrosive-resistant protective layer.

After the fuel element vessel is filled in the hot cell with radioactive material, the sealing cover of the container is welded to the vessel. The weld which joins the two weld platings to each other is a cold-weldable material. In this connection, it is noted that a cold-weldable material is a material, which can be welded without the necessity of conducting a follow-up heat treatment. In a cold-weldable material, no significant stresses or structural changes occur when this material is welded so that no micro-fissures can develop in the weld which must be corrected by an additional follow-up heat treatment. A cold-weldable material of this kind is NiMo 16Cr16Ti, which is known in Germany under the trade name "Hastelloy C-4". The projection of the weld plating on the cover and on the vessel is covered in part by the corrosive-resistant protection layer to ensure a complete seal.

The joint surface defined by the upper end portion is the end face of the vessel and, according to another feature of the invention, the joint surface of the cover is an annular surface formed thereon so as to extend inwardly and downwardly thereby causing the end face and the annular surface to conjointly define an outwardly facing V-shaped groove for receiving the weld.

BRIEF DESCRIPTION OF THE DRAWING

The invention will now be described with reference to the drawing wherein.

DESCRIPTION OF THE PREFERRED EMBODIMENTS OF THE INVENTION

Figure 1:
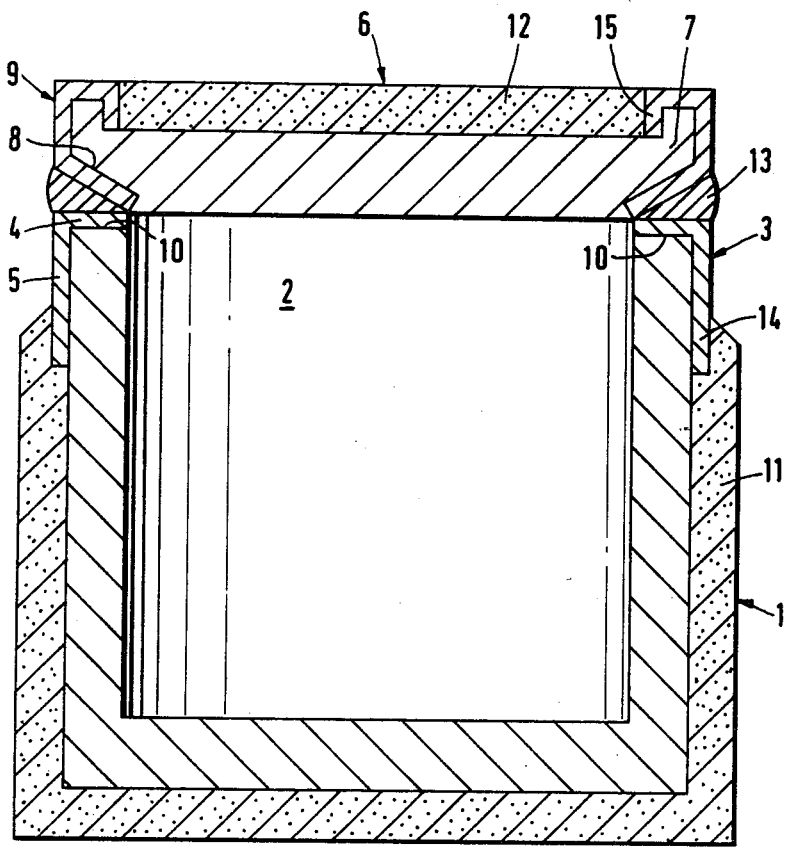
FIG. 1 is an elevation view, in section, illustrating a container according to the invention wherein the weld platings at the partition interface extends over a portion of the outside surface of the container and over the joint surfaces.

The container for storing radioactive material includes a cylindrical vessel 1 which is opened at one end. In this way, the upper end portion of the vessel defines the receiving opening 2 for loading the vessel with fuel elements (not shown). The cover and vessel are made of a mechanically strong material such as steel or cast steel.

The upper end portion of the vessel 1 and the peripheral portion of the cover 6 define respective joint surfaces 10 and 8. These joint surfaces are mutually adjacent and define the partition interface between the vessel 1 and cover 6 when the cover is seated on the vessel.

Weld receiving means are arranged at the partition interface for receiving a weld. The weld receiving means includes weld platings 3 and 9. The weld plating 3 is applied to joint surface 10 of the upper end portion of the vessel 1 and to a portion of the outside surface of the vessel as shown. The weld plating 3 is annular and is made of cold-weldable, corrosive resistant material. A material of the kind from which the annular weld plating is made is an alloy NiMo 16Cr16Ti having the trade name "Hastelloy C-4".

The annular weld plating 3 has an L-shaped section of which the shorter leg 4 is placed on the joint surface 10 which is the upper end face of the vessel. The longer leg 5 lies on the outside surface of the vessel 1.

The vessel 1 is closed by a sealing cover 6 welded thereto. This cover 6 has a peripheral portion which includes an annular upwardly extending projection 7 formed at the outer surface thereof. At the region of the peripheral portion facing the vessel 1, the cover 6 is beveled to define a circular annular surface 8. The projection onto a horizontal plane of this ringshaped surface 8 has a width which extends from inner diameter of the vessel to the outer diameter thereof.

The peripheral portion of the cover 6 is enclosed about its entire periphery with a weld plating 9 likewise made of a cold-weldable material. The weld plating is in the form of an annular band extending laterally from the projection 7 to the inner edge of the annular surface 8.

The weld platings 3 and 9 are applied to the steel vessel 1 and to the cover 6, respectively, by surface-layer welding and are built up by depositing layer upon layer of the cold weldable material Hastelloy C-4.

After being weld plated, the sealing cover 6 and the vessel 1 are coated with corrosion-resistant layer means in the form of corrosion protective layers 11, 12 made of a material such as graphite. If desired other materials such as ceramic or enamel could be used. These corrosion protective layers 11, 12 are put down so that the weld platings 3 and 9 are left exposed in the region whereat welding for sealing the container is to take place. However, the lower end 14 of weld plating 3 and the peripheral edge 15 of the weld plating 9 are covered over by corrosion protective layers 11 and 12, respectively. This ensures that no crack-like opening will develop between weld plating and corrosion protective layer which could lead to moisture reaching the steel base material of the vessel and/or cover.

As mentioned above, the corrosion protective layers 11 and 12 can be made of a material selected from the group including graphite, ceramic and enamel. Por example, a ceramic layer can be applied by plasma spraying sinter ceramic such as $Al_2O_3$ onto the vessel and cover. On the other hand, a graphite corrosion-protective layer can be applied by pressing a mixture of carbon and a binder onto the outside surface of the cover and vessel under high pressure and at high temperature. If desired, enamel can be used to form the corrosion-protective layer.

The enamel layers can be applied by brushing a dry powder including $Al_2O_3$ and $SiO_2$ onto the outer surfaces of the cover and vessel. The parts are then placed in an oven so that the powder can melt whereafter it is permitted to cool down thereby forming the enamel layers.

The downwardly inclining annular surface 8 of the cover 6 and end face 10 of the vessel conjointly define a wedge-shaped gap which opens outwardly. This wedge-shaped gap receives the V-shaped weld seam 13 made of corrosion resistant metal material such as Hastelloy C-4. This weld 13 is applied to the closed container in the hot cell and is likewise put down layer upon layer by means of the surface-layer welding process.

Both the weld platings and the corrosion protective layers are applied outside of the hot cell and are carefully inspected before being placed therein. These parts are fully quality assured so that only the integrity of the sealing weld which is later applied in the hot cell must be checked, for example, by sonic testing.

Because a cold-weldable material is utilized for the weld platings 3 and 9 and for the weld seam 13, no follow-up heat treatment is needed and the operation in the hot cell is kept simple and the complications which are possible with a heat treatment are avoided.

Figure 2:
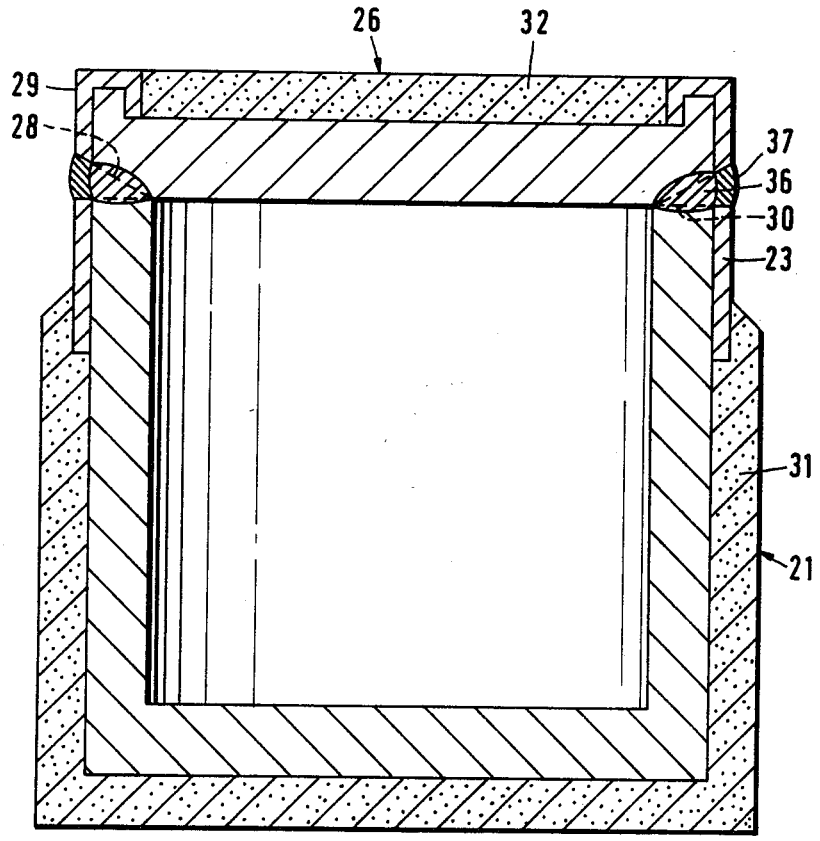
FIG. 2 is an elevation view, in section of a container of the invention wherein the weld platings extend only up to the joint surfaces and wherein two mutually contiguous welds close the container at the partition interface.

Referring to FIG. 2, there is shown an alternative embodiment of the container of the invention. The weld receiving means in the form of weld platings 23 and 29 are arranged at the partition interface between the cover 26 and the vessel 21 in the manner shown. The weld plating 23 extends from the corrosion-protective layer 31 up to the joint surface 30 of vessel 21 and weld plating 29 extends from the corrosion protective layer 32 to the joint surface 28. Thus, the joint surfaces 30 and 28 which define the partition interface have no weld plating formed thereon. The weld platings 23 and 29 are both put down by the surface-layer welding process and are made of a cold-weldable material The joint surfaces 30 and 28 are indicated by broken lines and show these surfaces as they appear before formation of the tulip weld 36 in the hot cell.

After the vessel 21 is filled in a hot cell with radioactive material and the cover 26 is seated thereon, the first weld 36 is applied by the shielded-gas arc welding process. This is followed by the application of a second weld 37 which is put down by the surface-layer welding process. Second weld 37 is made of cold wedable material such as Hastelloy C-4. Both welds 36 and 37 are applied to the container in the hot cell.

Thus, in this embodiment too, no follow-up heat treatment is reqired. Any micro fissures which should develop in weld 36 are sealed by weld 37. The application of weld 37 is followed by testing the integrity thereof by a suitable testing means such as sonic testing.

Figure 3:
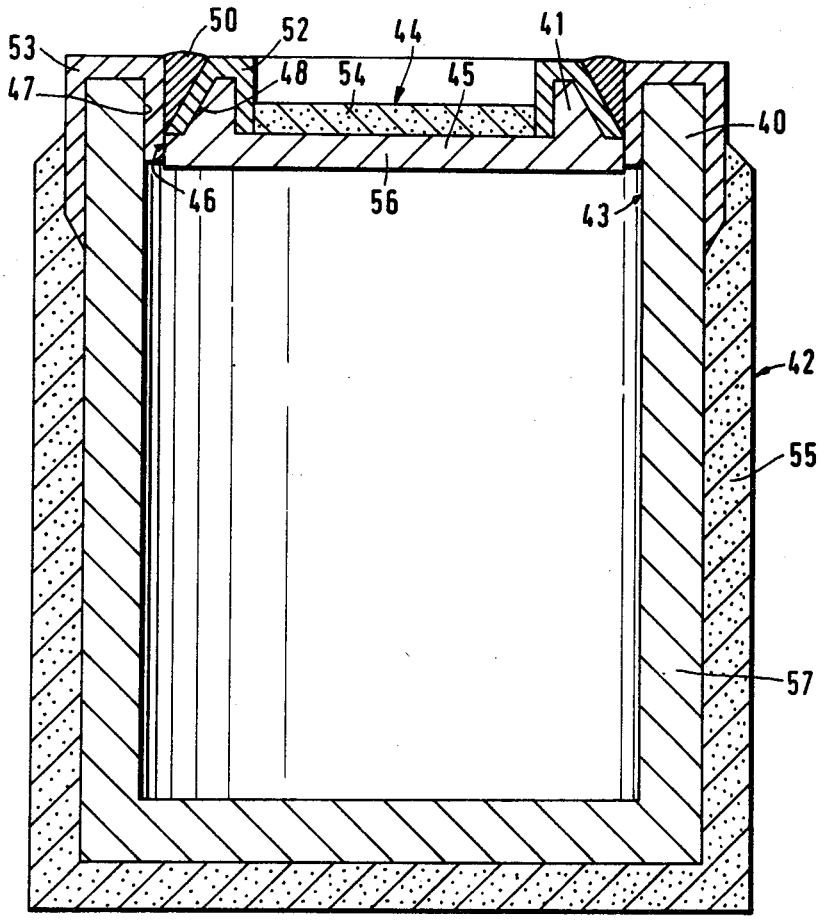
FIG. 3 is an elevation view, in section of a container of the invention wherein outwardly extending welding lips conjointly define the partition interface.

The embodiment shown in FIG. 3 incorporates welding lips 40 and 41 and is described with respect to this and other features in my copending U.S. patent application entitled "A Container for Transporting and Storing Nuclear Reactor Fuel Elements" filed on Oct. 22, 1982.

The container shown in FIG. 3 includes a vessel 42 made of steel or cast steel. The vessel 42 is of cylindrical configuration and has an opening 43 at one of its ends through which the vessel is loaded with radioactive material such as spent nuclear reactor fuel elements (not shown). A sealing cover 44 is placed in the opening 43. This sealing cover 44 includes a peripheral portion 41 which extends in a direction perpendicular to the central portion 45 of the cover. The cover therefore has a U-shaped configuration when viewed in section.

The peripheral portion 41 abuts with its outer surface 46 against the inner surface 47 of the wall of the vessel. In this way, the peripheral portion 41 of the cover 44 and the upper end portion 40 of the vessel 42 are tightly fitted with each other. The portion of the vessel 42 beneath the upper end portion 40 is defined as the main portion of the vessel.

The outer surface 46 and the inner surface 47 are joint surfaces of the cover 44 and vessel 42, respectively, and conjointly define the partition interface for receiving a weld to seal the container with respect to the ambient. The joint surface 46 includes a tapered portion indicated by reference numeral 48. The tapered portion 48 and surface 47 conjointly define a groove for receiving the weld 50.

Weld receiving means in the form of weld platings 52 and 53 are applied to the outer surfaces of cover 44 and vessel 42, respectively, as shown. The weld plating 52 extends downwardly to cover the tapered portion 48 of the joint surface 46 of the cover 44. Weld plating 53 extends downwardly to cover the joint surface 47 of vessel 42. The weld platings 52 and 53 can be made of Hastelloy C-4 and are applied by the surface-layer welding process. Corrosion-protective layer means in the form of layers 54 and 55 are applied to the cover and vessel, respectively, and can be made of a material such as graphite, ceramic or enamel.

Corrosion-protective layers 54, 55 and weld platings 52, 53 protect the steel portion 56 of cover 44 and steel portion 57 of vessel 42 against corrosion while the steel portions 56 and 57 provide the container with mechanical strength and stability.

After the vessel and cover are provided with the weld platings and corrosion-protective layers, tbe container is ready for use in storing radioactive material. The vessel and cover are placed in a hot cell wherein the vessel is filled with radioactive material whereafter the cover is seated in place and a weld 50 is applied by the surface-layer welding process and can be made of Hastelloy C-4. The weld 50 joins the weld platings 52 and 53 about the entire periphery of the container thereby forming a corrosive resistant seal.

Thus, the container of the invention includes a cover and a vessel both made of a high-strength material such as steel or cast steel. The cover and vessel are made resistant to corrosion by applying weld platings made of cold-weldable material at the partition interface and corrosive resistant layers to the respective outer surfaces of cover and vessel as shown for above embodiments. After the container is filled with radioactive material in the hot cell, a weld made of cold-weldable material is applied to seal the container from the ambient.

Because the container is sealed with a weld of cold-weldable material, a follow-up heat treatment operation to remove micro-fissures is not required and operations in the hot cell are kept simple. At the same time, a container is realized which is resistant to corrosion and has high strength because the base material is made of steel. The container is therefore suitable for the long-term storage of radioactive material. If desired, the container can also be used for the interim storage of radioactive material.

Other modifications and variations to the embodiments described will now be apparent to those skilled in the art. Accordingly, the aforesaid embodiments are not to be construed as limiting the breadth of the invention. The full scope and extent of the present contribution can only be appreciated in view of the appended claims.

I claim:

1. A container for the long-term storage of radioactive materials such as spent nuclear reactor fuel elements comprising:

a vessel made of a metal selected from the group consisting of steel and cast steel and having a base and a wall extending upwardly from said base, said wall terminating in an upper end portion defining the opening of the vessel through which the radioactive material to be stored therein is passed;

a cover likewise made of a metal selected from the group consisting of steel and cast steel for sealing the opening of said vessel, said cover having a peripheral portion for engaging said vessel; said upper end portion of said vessel and said peripheral portion of said cover defining respective joint surfaces, said joint surfaces being mutually adjacent and defining the partition interface between said vessel and said cover when said cover is seated on said vessel;

surface layers of corrosion-resistant metal welded to said joint surfaces, respectively, to conjointly define a composite weld receiving surface when said cover is seated on said vessel;

corrosion-protective layer means formed on the respective outer surfaces of said cover and said vessel, said layer means extending over each of said outer surfaces up to and being in contact with and overlapping a portion of said composite weld receiving surface whereby said corrosion-protective layer means and said composite weld receiving surface conjointly cover and protect the respective entire outer surfaces of said vessel and said cover against corrosion; and, a weld of corrosion-resistant metal applied to said composite weld receiving surface at said partition interface to tightly join said cover to said vessel thereby sealing said partition interface and said container with respect to the ambient; and, said weld being free of unwanted microfissures and said corrosion-resistant metal being a metal which is welded without the necessity of conducting a follow-up heat treatment to remove such unwanted microfissures.

2. The container of claim 1, said corrosion-protective layer means including one layer formed on said outer surface of said vessel and an other layer formed on said outer surface of said cover, each one of said layers being made of a material selected from the group consisting of graphite, ceramic and enamel.

3. The container of claim 2, said composite weld receiving surface comprising: a first weld plating on the outer surface of said vessel extending from said one layer up to said joint surface of said vessel and, a second weld plating on the outer surface of said cover extending from said other layer up to said joint surface of said cover.

4. The container of claim 3, said first and second weld platings being build up on said vessel and said cover, respectively, by the process of surface-layer welding.

5. The container of claim 3, said joint surface defined by said upper end portion being the upper end face of said vessel; said joint surface of said cover being an annular surface formed on said cover so as to extend inwardly and downwardly thereby causing said end face and said annular surface to conjointly define an outwardly facing V-shaped groove for receiving said weld.

6. The container of claim 5, said first and second weld platings being built up on said vessel and said cover, respectively, by the process of surface-layer welding

7. The container of claim 5, said peripheral portion of said cover including an annular upwardly extending projection formed thereon in spaced relationship to said annular surface, said second weld plating being built-up on said cover so as to be in the form of an annular band extending laterally from said projection up to said annular surface of said cover.

8. The container of claim 3, said first weld plating being extended to also cover said joint surface of said vessel and, said second weld plating being extended to also cover said joint surface of said cover whereby said first and second weld platings each are L-shaped when viewed in section.

9. The container of claim 8, said first and second weld platings being built up on said vessel and said cover, respectively, by the process of surface-layer welding.

10. The container of claim 8, said joint surface defined by said upper end portion being the upper end face of said vessel; said joint surface of said cover being an annular surface formed on said cover so as to extend inwardly and downwardly thereby causing said end face and said annular surface to conjointly define an outwardly facing V-shaped groove for receiving said weld.

11. The container of claim 10, said first and second weld platings being build up on said vessel and said cover, respectively, by the process of surface-layer welding.

12. The container of claim 10, said peripheral portion of said cover including an annular upwardly extending projection formed thereon in spaced relationship to said annular surface, said second weld plating being built up on said cover so as to be in the form of an annular band extending laterally from said projection to the inner edge of said annular surface of said cover.

13. A container for the long-term storage of radioactive materials such as spent nuclear reactor fuel elements comprising:

a vessel made of a metal selected from the group consisting of steel and cast steel and having a base and a wall extending upwardly from said base, said wall terminating in an upper end portion defining the opening of said vessel through which the radioactive material to be stored therein is passed;

a cover likewise made of a metal selected from the group consisting of steel and cast steel for sealing the opening of said vessel, said cover having a peripheral portion for engaging said vessel;

said upper end portion of said vessel and said peripheral portion of said cover defining respective joint surfaces, said joint surfaces being mutually adjacent and conjointly defining the partition interface between said vessel and said cover when said cover is seated on said vessel;

said composite weld receiving surface, upon being welded, results in a corrosion-resistant metal weld being free of unwanted microfissures without the necessity of conducting a follow-up heat treatment to remove such unwanted microfissures; and, surface layers of corrosion-resistant metal welded to said joint surfaces, respectively, to conjointly define a composite weld receiving surface when said cover is seated on said vessel; and, corrosion-protective layer means formed on the respective outer surfaces of said cover and said vessel, said layer means extending over each of said outer surfaces up to and being in contact with and overlapping a portion of said composite weld receiving surface whereby said corrosion-protective layer means and said composite weld receiving surface conjointly cover and protect the respective entire outer surfaces of said vessel and said cover against corrosion.

14. The container of claim 13 comprising: a weld made of corrosion-resistant metal applied to said composite weld receiving surface at said partition interface to tightly join said cover to said vessel thereby sealing said partition interface and said container with respect to the ambient; and, said weld being free of unwanted microfissures and said corrosion-resistant metal being a metal which is welded without the necessity of conducting a follow-up heat treatment to remove such unwanted microfissures.

15. The container of claim 13 wherein: said corrosion-protective layer means including one layer formed on said outer surface of said vessel and an other layer formed on said outer surface of said cover, each one of said layers being made of a material selected from the group consisting of graphite, ceramic and enamel; said composite weld receiving surface including a first weld plating on the outer surface of said vessel extending from said one layer up to said joint surface of said vessel and, a second weld plating on the outer surface of said cover extending from said other layer up to said joint surface of said cover; said weld including a first weld applied to said joint surfaces at said partition interface to join said joint surfaces to each other about the entire periphery of said container; and a second weld made of corrosion resistant metal and applied over said first weld at said partition interface to join said first weld plating to said second weld plating about the entire periphery of said container thereby sealing said partition interface and said container with respect to the ambient; and, said weld being free of unwanted microfissures and said corrosion-resistant metal being a metal which is welded without the necessity of conducting a follow-up heat treatment to remove such unwanted microfissures.

16. The container of claim 15, said first weld being a weld laid down by the shielded-gas arc-welding process and said second weld being a weld applied by the surface-layer welding process.

17. A container for the long-term storage of radioactive materials such as spent nuclear reactor fuel elements comprising:

a vessel made of a metal selected from the group consisting of steel and cast steel and having a base and a wall extending upwardly from said base, said wall terminating in an upper end portion defining the opening of the vessel through which the radioactive material to be stored therein is passed; the portion of said vessel beneath said upper end portion being the main portion of the vessel wherein the radioactive material is stored;

a cover likewise made of a metal selected from the group consisting of steel and cast steel for sealing the opening of said vessel, said sealing cover having a central portion and a peripheral portion extending outwardly from said central portion;

said cover being seated on said vessel so as to cause said peripheral portion and said upper end portion to mutually abut thereby causing said central portion and said main portion to conjointly define a chamber for completely enclosing the radioactive material;

said peripheral portion and said upper end portion extending outwardly away from said chamber to define respective welding lips, said welding lips having respective joint surfaces, said joint surfaces being mutually adjacent and conjointly defining the partition interface between said vessel and said cover when said cover is seated on said vessel;

said composite weld receiving surface upon being welded, results in a corrosion-resistant metal weld being free of unwanted microfissures without the necessity of conducting a follow-up heat treatment to remove such unwanted microsfissures; and surface layers of corrosion-resistant metal welded to said joint surfaces, respectively, to conjointly define a composite weld receiving surface when said cover is seated on said vessel; and, corrosion-protective layer means formed on the respective outer surfaces of said cover and said vessel, said layer means extending over each of said outer surfaces up to and being in contact with and overlapping a portion of said composite weld receiving surfaces whereby said corrosion-protective layer means and said composite weld receiving surface conjointly cover and protect the respective entire outer surfaces of said vessel and said cover against corrosion.

18. The container of claim 17 comprising: a weld made of corrosion resistant metal applied to said composite weld receiving surfaces at said partition interface to tightly join said cover to said vessel thereby sealing said partition interface and said container with respect to the ambient; and, said weld being free of unwanted microfissures and said corrosion-resistant metal being a metal which is welded without the necessity of conducting a follow-up heat treatment to remove such unwanted microfissures.

19. The container of claim 18, said peripheral portion defining one of said welding lips extending upwardly at a right angle to said central portion so as to define a trough-like cover having a U-shaped section, said upper end portion of said wall defining the other one of said welding lips extending upwardly from said base in a direction substantially perpendicular thereto, said welding lips having respective peripheral edges, said cover being mounted in said opening so that said peripheral edges are at the same elevation in a common plane extending transversely to said partition interface.

20. The container of claim 19, said corrosion-protective layer means including one layer formed on said outer surface of said vessel and an other layer formed on said outer surface of said cover, each one of said layers being made of a material selected from the group consisting of graphite, ceramic and enamel.

21. The container of claim 20, said composite weld receiving surface comprising: a first weld plating on the peripheral edge of said welding lip of said vessel, said first weld plating extending from said one layer and covering said joint surface of said vessel; and, a second weld plating on the peripheral edge of said welding lip of said cover, said second welding lip extending from said other layer and covering said joint surface of said cover.

22. The container of claim 21, said first and second weld platings being built up on said peripheral and said joint surfaces by the surface-layer welding process.

* * * * *

UNITED STATES PATENT AND TRADEMARK OFFICE

CERTIFICATE OF CORRECTION

PATENT NO. : 4,596,688

DATED : June 24, 1986

INVENTOR(S) : Franz-Wolfgang Popp

It is certified that error appears in the above-identified patent and that said Letters Patent is hereby corrected as shown below:

On the first page of the patent, after the heading "Inventor: Franz-Wolfgang Popp, Kuhstrasse 5, 3002 Wedemark, Fed. Rep. of Germany": insert the new heading -- Assignee: Deutsche Gesellschaft für Wiederaufarbeitung von Kernbrennstoffen mbH, Hanover, Fed. Rep. of Germany --.

On the first page of the patent, under the heading "Other Publications": delete "Cooper Alloys," and substitute -- Copper Alloys, -- therefor.

In column 1, line 37: delete "micro fissures occuring" and substitute -- microfissures occurring -- therefor.

In column 1, line 54: delete "is" and substitute -- were -- therefor.

UNITED STATES PATENT AND TRADEMARK OFFICE

CERTIFICATE OF CORRECTION

PATENT NO. : 4,596,688

DATED : June 24, 1986

INVENTOR(S) : Franz-Wolfgang Popp

It is certified that error appears in the above-identified patent and that said Letters Patent is hereby corrected as shown below:

In column 1, line 65: delete "micro-fissures" and substitute -- microfissures -- therefor.

In column 3, line 24: delete "micro-fissures" and substitute -- microfissures -- therefor.

In column 3, line 45: delete "extends" and substitute -- extend -- therefor.

In column 3, line 48: add a comma after the word "section".

In column 3, line 53: add a comma after the word "section".

UNITED STATES PATENT AND TRADEMARK OFFICE

CERTIFICATE OF CORRECTION

PATENT NO. : 4,596,688

DATED : June 24, 1986

INVENTOR(S) : Franz-Wolfgang Popp

It is certified that error appears in the above-identified patent and that said Letters Patent is hereby corrected as shown below:

In column 4, line 23: delete "ringshaped" and substitute -- ring-shaped -- therefor.

In column 4, line 24: delete "from inner" and substitute -- from the inner -- therefor.

In column 4, line 38: add a comma after the word "desired".

In column 4, line 52: delete "Por" and substitute -- For -- therefor.

In column 5, line 38: delete "arc welding" and substitute -- arc-welding -- therefor.

In column 5, line 41: delete "cold wedable" and substitute -- cold-weldable -- therefor.

UNITED STATES PATENT AND TRADEMARK OFFICE

CERTIFICATE OF CORRECTION

PATENT NO. : 4,596,688

DATED : June 24, 1986

INVENTOR(S) : Franz-Wolfgang Popp

It is certified that error appears in the above-identified patent and that said Letters Patent is hereby corrected as shown below:

In column 5, line 45: delete "reqired. Any micro fissures" and substitute -- required. Any microfissures -- therefor.

In column 5, line 53: delete "1982." and substitute -- 1982, having serial no. 436,033, now abandoned. -- therefor.

In column 6, line 29: delete "tbe" and substitute -- the -- therefor.

In column 6, line 51: delete "micro-fissures" and substitute -- microfissures -- therefor.

In column 7, line 68: add a period after the word "welding".

UNITED STATES PATENT AND TRADEMARK OFFICE

CERTIFICATE OF CORRECTION

PATENT NO. : 4,596,688

DATED : June 24, 1986

INVENTOR(S) : Franz-Wolfgang Popp

It is certified that error appears in the above-identified patent and that said Letters Patent is hereby corrected as shown below:

In column 8, line 4: delete "built-up" and substitute -- built up -- therefor.

In column 8, lines 55 to 63, delete the following:

"said composite weld receiving surface, upon being welded, results in a corrosion-resistant metal weld being free of unwanted microfissures without the necessity of conducting a follow-up heat treatment to remove such unwanted microfissures; and, surface layers of corrosion-resistant metal welded to said joint surfaces, respectively, to conjointly define a composite weld receiving surface when said cover is seated on said vessel; and,"

UNITED STATES PATENT AND TRADEMARK OFFICE

CERTIFICATE OF CORRECTION

PATENT NO. : 4,596,688

DATED : June 24, 1986

INVENTOR(S) : Franz-Wolfgang Popp

It is certified that error appears in the above-identified patent and that said Letters Patent is hereby corrected as shown below:

and substitute the following therefor:

-- surface layers of corrosion-resistant metal welded to said joint surfaces, respectively, to conjointly define a composite weld receiving surface when said cover is seated on said vessel;

said composite weld receiving surface, upon being welded, results in a corrosion-resistant metal weld being free of unwanted microfissures without the necessity of conducting a follow-up heat treatment to remove such unwanted microfissures; and, --

UNITED STATES PATENT AND TRADEMARK OFFICE

CERTIFICATE OF CORRECTION

PATENT NO. : 4,596,688

DATED : June 24, 1986

INVENTOR(S) : Franz-Wolfgang Popp

It is certified that error appears in the above-identified patent and that said Letters Patent is hereby corrected as shown below:

In column 10, lines 8 to 16, delete the following:

"said composite weld receiving surface, upon being welded, results in a corrosion-resistant metal weld being free of unwanted microfissures without the necessity of conducting a follow-up heat treatment to remove such unwanted microsfissures; and, surface layers of corrosion-resistant metal welded to said joint surfaces, respectively, to conjointly define a composite weld receiving surface when said cover is seated on said vessel; and,"

UNITED STATES PATENT AND TRADEMARK OFFICE

CERTIFICATE OF CORRECTION

PATENT NO. : 4,596,688

DATED : June 24, 1986

INVENTOR(S) : Franz-Wolfgang Popp

It is certified that error appears in the above-identified patent and that said Letters Patent is hereby corrected as shown below:

and substitute the following therefor:

-- surface layers of corrosion-resistant metal welded to said joint surfaces, respectively, to conjointly define a composite weld receiving surface when said cover is seated on said vessel;

said composite weld receiving surface, upon being welded, results in a corrosion-resistant metal weld being free of unwanted microfissures without the necessity of conducting a follow-up heat treatment to remove such unwanted microfissures; and, --

In column 10, line 22: delete "surfaces" and substitute -- surface -- therefor.

In column 10, line 28: delete "surfaces" and substitute -- surface -- therefor.

Signed and Sealed this

Sixteenth Day of December, 1986

*Attest:*

DONALD J. QUIGG

*Attesting Officer* *Commissioner of Patents and Trademarks*